United States Patent [19]

Sprague

[11] 4,022,168

[45] May 10, 1977

[54] TWO-CYCLE ROTARY-RECIPROCAL-ENGINE

[76] Inventor: John S. Sprague, Pacific Marina No. 808, Alameda, Calif. 94501

[22] Filed: Sept. 11, 1975

[21] Appl. No.: 612,637

[52] U.S. Cl. ..... 123/43 A; 91/501
[51] Int. Cl.[2] ..... F02B 57/06
[58] Field of Search ..... 123/43 A; 91/501

[56] References Cited

UNITED STATES PATENTS

| | | | |
|---|---|---|---|
| 137,261 | 3/1873 | Taylor | 123/44 E |
| 968,969 | 8/1910 | Ord | 91/501 |
| 1,063,456 | 6/1913 | Looney | 123/43 A |
| 1,209,995 | 12/1916 | Ord | 123/43 A |
| 1,332,756 | 3/1920 | Root | 91/501 X |
| 1,389,873 | 9/1921 | Hult | 123/43 A |
| 1,972,335 | 9/1934 | Gardner | 123/43 A |
| 1,987,699 | 1/1935 | Moore | 123/43 A |
| 2,957,462 | 10/1960 | Clark | 91/501 X |
| 3,196,698 | 7/1965 | Liddington | 91/501 X |

FOREIGN PATENTS OR APPLICATIONS

| | | | |
|---|---|---|---|
| 121,656 | 1/1919 | United Kingdom | 123/43 A |

*Primary Examiner*—Clarence R. Gordon
*Attorney, Agent, or Firm*—Bielen and Peterson

[57] ABSTRACT

A two-cycle reciprocal, rotary, internal combustion engine having a plurality of piston cylinders mounted symmetrically around a cylindrical central supply core; each piston cylinder contains two oppositely reciprocating pistons having a common central combustion chamber, the cylinders and pistons are encased in a rotor housing which rotates as a unit around the stationary central core; the central supply core projects from each end of the rotor housing and has stationary elliptical drive plates mounted at an inclination on the ends of the supply core, the inclined drive plates interface cooperatively inclined end faces of the pistons which project through the barrel housing and slide against the drive plates as the barrel housing rotates; rotation results from selective combustion during the reciprocal cycle of the pistons, an angular force being developed by the inclination of the end plates.

20 Claims, 4 Drawing Figures

FIG. 2
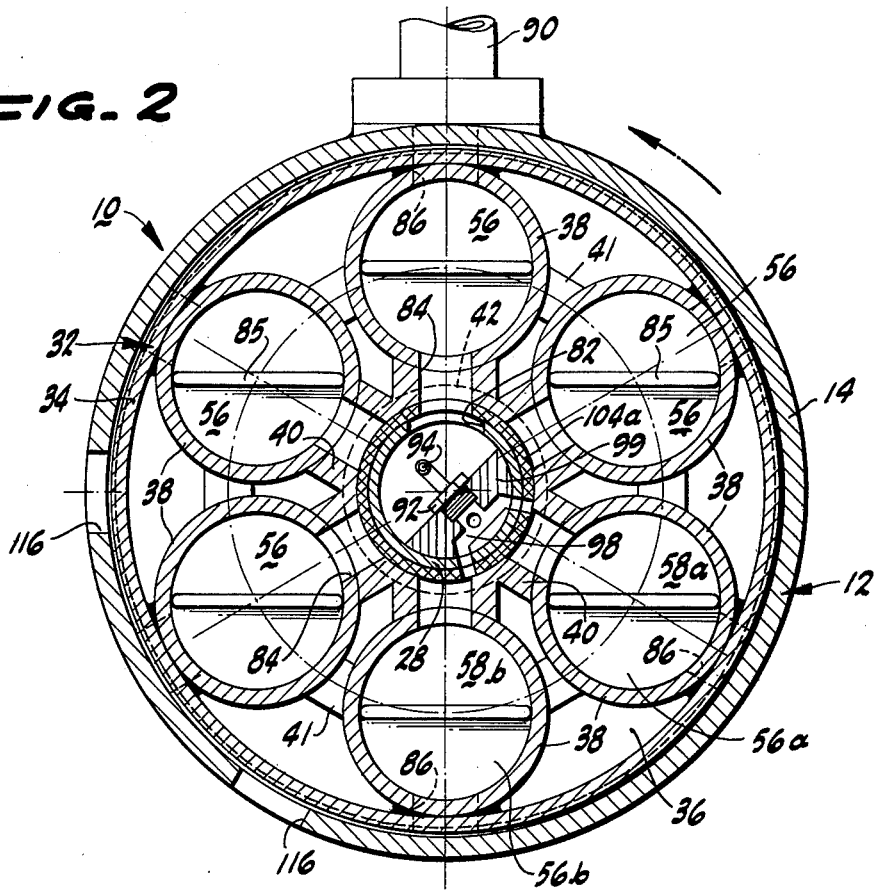
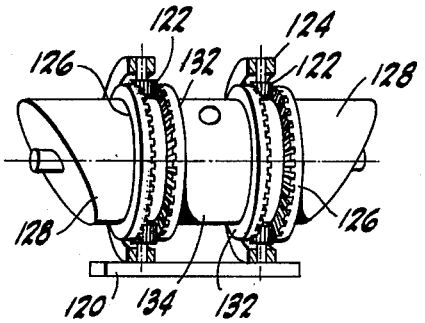
FIG. 3
FIG. 4
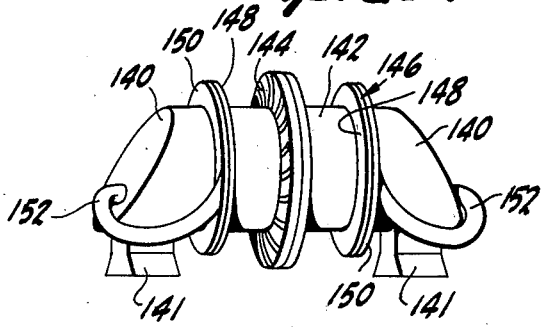

TWO-CYCLE ROTARY-RECIPROCAL-ENGINE

BACKGROUND OF THE INVENTION

This invention relates to a two-cycle reciprocal, rotary, internal combustion engine. This engine adapts certain principles of the opposed piston engine and the free-piston engine, both of which operate on a two-cycle principle.

In the opposed piston engine, two pistons move in opposite directions in the same cylinder. The two pistons are connected by cranks to separate crank shafts which are generally geared to a common drive shaft. Usually, the air-fuel intake port is located in the common chamber adjacent the bottom stroke of one piston and the combustion exhaust port is located adjacent the bottom stroke of the opposite piston to provide a uniflow-scavenged system. A relatively high power output is in this engine obtainable from a relatively lightweight power plant. However, fuel inefficiencies and the crank drive losses reduce the advantages otherwise inherent in the opposed piston engine.

In the free-piston engine, opposed power pistons move in the same cylinder in a manner similar to the opposed piston engine. However, the power pistons are connected directly at the distal ends to larger compressor pistons in a separate chamber. This engine originally operated primarily as a compressor, but has evolved into a turbine engine utilizing exhaust gases from the power pistons as the driving gas. The compressor pistons supercharged the intake air for subsequent further compression in the combustion chamber for the power pistons. The high compression pressures in the combustion chamber permit the engine to operate with a fuel injection system. High compression ratios are possible since there are no bearing surfaces to be loaded as in a crank system. Limitation of the system to a turbine unit renders the engine useful generally for only large unit applications.

Other engines and pump units have certain operational features similar to the engine of this invention. For example, the NSU-Wankel engine is a rotary internal combustion engine utilizing a triangular rotating piston which is eccentrically mounted within a two lobed epitrochoid casing. The piston essentially forms a three chamber system from the triangular piston or rotor configuration. The eccentrically mounted rotor sequentially forms intake and compression, and combustion and exhaust functions as it rotates in the two lobes of the casing. This continuous sequential power process is similar in concept to the continuous sequential power process of the subject device.

A recently developed free piston. rotary engine utilizes certain operational features which are similar in principle to certain features of the subject device and, perhaps, is closest in general operating principle to the subject invention.

In this engine, called a rotary V engine, a plurality of cylinders are concentrically and symmetrically arranged in two sets around two separate axes of rotation. The axes intersect at a predetermined angle in the range of 20° to 45°. A single set of identical pistons each formed in a V configuration reciprocate in the two sets of cylinders, each piston having one free end slidably engaged in one cylinder of one set and its opposite free end slidably engaged in one cylinder of the other set. Each cylinder set is arranged in a separate cylindrical rotor housing with orthagonal transverse ends. The two rotor housings are retained within a stationary outer housing which enables cooperative rotation of each set of cylinders and contained piston ends within the stationary outer casing.

The central portion of each piston proximate the V-intersection of its two segments, is outside each of the two cylindrical housings. Because of the concentric arrangement of the respective segments of the V-pistons around the respective intersecting axes of rotation, the relative position of the piston ends in the two cylindrical rotor housings follows an elliptical locus as the rotor housings are rotated. In effect, the piston ends reciprocate within the cylinders although the junctures of the piston segments at the V-intersection remain co-planar.

The far ends of the rotor housings are capped and provided with the necessary valving and ignition systems to form a series of combustion chambers which are appropriately fired in continuous sequence to drive the two rotor housings around their respective axes.

While the several above described engines each have certain similarities to the subject engine, the subject engine as a whole differs substantially from each of the above described engines taken individually. Many of the undesirable features of the above-described engines, such as the use of cranks, complex seals, V-configurations, etc., are avoided by the subject engine.

SUMMARY OF THE INVENTION

The subject invention incorporates certain of the desirable features of the above described engines, and incorporates certain other novel features into a unique rotary-reciprocal internal combustion engine. Combining the oppositely mounted, double piston characteristic of the opposed piston and free-piston engines, the symmetrical concentric cylinder arrangement and rotating cylinder housing characteristic of the rotary V-engine, as well as other desirable features from these and other engines, with other novel and unique features, a new, lightweight, high-powered engine is developed as here described in summary.

In the subject engine, a plurality of piston cylinders are mounted symmetrically around a central cylindrical supply core. Each of the piston cylinders contains two oppositely reciprocating pistons which form a common central combustion chamber, similar to the opposed-piston and free-piston engines. The cylinders with the containd pistons are mounted in a barrel shaped rotor housing which encompasses the symmetrically arranged cylinders. The rotor housing is concentric to and rotates around the central supply core.

The central supply core projects or extends beyond the ends of the rotor housing. Mounted at the ends of the supply core are elliptical drive plates which are fixed at an inclination to the supply core. The two drive plates are tilted toward each other in equilateral, trapezoidal fashion.

The pistons project from orthogonal end plates on the rotor housing, and extend beyond the effective length of the cylinders. The projecting ends of the pistons have an incline rather than orthogonal end face which interfaces flatly against the inclined drive plates.

In the preferred embodiment, the central supply core and attached drive plates are stationary and the rotor housing and contained cylinders and pistons rotate about the core on appropriate bearings.

Because of the toe-in arrangement of the drive plates, it can be provided that as the rotor housing rotates, a select pair of opposed pistons will come together as the projecting inclined end faces of the piston slide around the drive plate and approach the section where the two drive plates are closest together. To insure that the piston end faces remain in contact with the drive plates when the engine is not firing, for example during the ignition stage, the piston end faces have a projecting anchor which slidably engages a track in the drive plate. Thus, as the rotor is rotated and the select pair of opposed pistons approach the section of the drive plates which are farthest apart, the pistons are pulled apart. This reciprocal motion caused by the angular inclination of the drive plates and interfacing sliding pistons is utilized to drive the rotor when proper valving and fueling is added.

Appropriately, a two cycle valving arrangement is utilized allowing a concurrent charging and scavenging of the combustion chamber when the pistons are farthest apart. To accomplish this operation an outer overall stationary casing, attached at each end of the inclined drive plates, encloses the above-described apparatus except for two appropriately located exhaust ports through which the exhaust gases are scavenged. The air or air and fuel charge is introduced through intake ports in the central core located opposite the exhaust ports in the outer casing. Each cylinder includes a similar set of intake and exhaust ports which are normally closed by the blocking wall of the central core and the outer casing respectively, except when aligned with the exhaust ports in the central core.

In order to develop an air blast suitable to charge the cylinders and scavenge the burned gases, a supercharger inherent in the system is utilized. This supercharger or air pump is formed in the area in which the piston ends extend from the end plates of the rotor housing.

The use of air or air-fuel mixtures depends on the desired design of the engine as either a basic carbureted or fuel injected system, or for that matter, a combination of both.

Regardless of whether either or both systems are used, a self-ignition system is preferred in which a small crossover passage allows ignited gases from one cylinder to pass to the next adjacent cylinder to initiate ignition in the adjacent cylinder completing its compression cycle. In this manner, once the engine is initially fired, ignition will be self-perpetuating.

While the above summarily describes the basic engine of this invention, certain modifications and component additions may be included to enhance the operation. For example, both the core and cylinder assemblies can be driven in opposite directions to obtain a double firing sequence for each output rotation. Or, the exhaust gases from the reciprocal engine can be utilized to drive an integral turbine component. These and other features will become apparent from a consideration of the detailed description of the preferred embodiments.

BRIEF DESCRIPTION OF THE DRAWINGS

FIG. 2 is a cross-sectional end elevational view of the engine taken on the lines 2—2 of FIG. 1.

FIG. 3 is a perspective view of an alternate embodiment of the invention utilizing gears for opposite rotation of the main components.

FIG. 4 is a perspective view of a further alternate embodiment of the invention having a turbine fan and air compressor.

DETAILED DESCRIPTION OF THE PREFERRED EMBODIMENT

Figure 1:
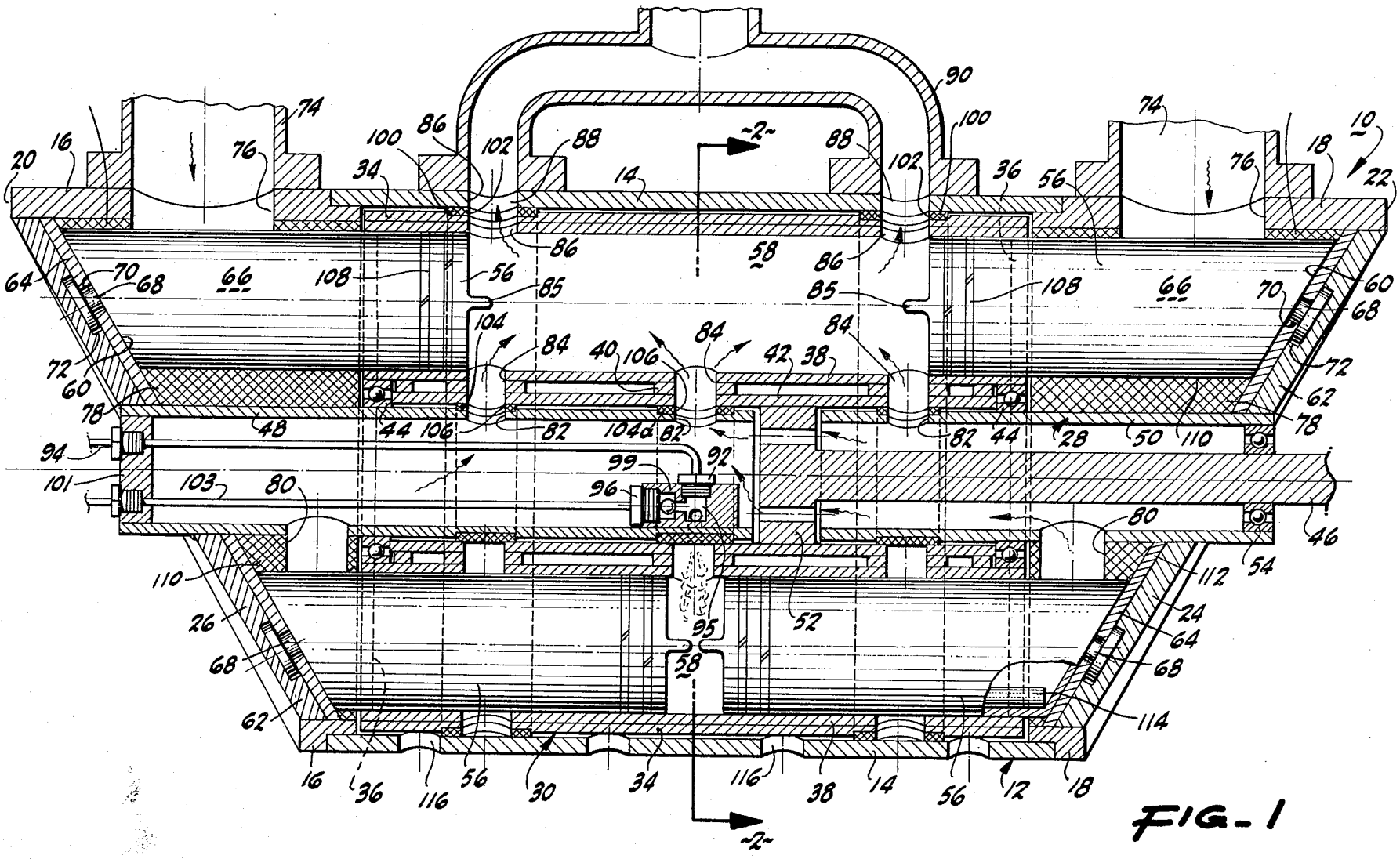
FIG. 1 is a cross-sectional, side elevational view of the preferred embodiment of the rotary-reciprocal engine.

Referring to FIG. 1, a cross-sectional view is shown of the preferred embodiment of the rotary-reciprocal engine, designated generally by the reference numeral 10. The rotary-reciprocal engine in this embodiment includes a stationary outer housing 12 formed of a cylindrical casing 14 connected to two cylindrical end segments 16 and 18. The end segments 16 and 18 terminal edges 20 and 22, respectively, which define a plane set at an incline, rather than orthogonal, to the centerline axis of the cylindrical casing. Attached to the terminal edges 20 and 22 are two elliptical, inclined drive pltes 24 and 26. A central core 28 extends along the centerline of the engine, connecting to the drive plates at each end.

Within the outer housing 12 is a rotor 30 which comprises a major portion of the mass of the engine. The rotor rotates around the core and provides the rotary driving power for the engine's output. The rotor 30 is formed of a rotor housing 32 having a cylindrical outer shell 34 with orthogonal end plates 36, as shown in FIG. 2. Referring to FIG. 2, six cylinders 38 are symmetrically arranged within the rotor housing 32 in a concentric pattern around the central cylindrical core 28. A webbing 40 and central sleeve 42 (shown in phantom) support the symmetrically arranged cylinders 38 in the rotor housing. Portions of the webbing function also as the induction and exhaust passages to the cylinders as discussed in greater detail hereafter.

The central sleeve 42 of the rotor housing, as shown in FIG. 1, rotates around the core 28 on roller bearings 44 at each end of the rotor. In order to transmit an output drive to a drive shaft 46, the central core 28 is split into two spaced segments, 48 and 50, respectively. In the space between the inner ends of these segments is a webbed hub 52 which connects the central sleeve 42 of the rotor 30 with the drive shaft 46, axially located within one segment 50 of the core 28. An end roller bearing 54 aids in supporting the drive shaft 46 which projects from the engine for connection to a desired output.

Within each of the symmetrically arranged cylinders are two opposed pistons 56 which define a combustion chamber 58 therebetween. The pistons 56 extend beyond the cylinders 38 through the orthogonal end plates 36 of the rotor 30. An inclined end face 60 at the distal ends of the pistons 56 interfaces the drive plates 24 and 26 at each end of the outer housing 12. Each of the drive plates 24 and 26 is formed with an outer cast end plate 62 and an inner tempered steel slide plate 64. The piston end faces, which are similarly tempered, slide against the slide plates 64 on a thin oil film formed either by an oil supply system (not shown) or by an oil fuel mixture supplied to the engine through a series of supercharging induction chambers 66 described in greater detail hereafter.

In order to insure that the end faces 60 of the pistons 56 remain slideably engaged with the slide plates 64, each piston 56 has a T-shaped anchor pin 68 which is locked in an elliptical track 70 in the slide plates and an elliptical passage 72 in the end plates. Generally, the anchor pins have a necessary function only during a start-up cycle. After firing begins the force of the expanding gases will maintain the pistons against the slide plates.

The rotary-reciprocal engine of this invention operates on a two cycle combustion process with a compression stroke and an expansion stroke. The engine is operable on an air fuel induction system, a fuel injection system or a combination of both. For an overall description, a combination system will be described.

An air-fuel mixture from a carburetor throat 74 enters the top or elongated sector of the outer housing through induction ports 76 in the end segments 16 and 18 of the outer housing 12. If desired, the induction port and carburetor throat may alternately be located on the drive plates 26. The gas mixture is pumped by a series of induction chambers formed by the end segments 16 and 18, the end plates 36 of the rotor 30, the drive plates 24, and enlarged segment 78 of the core and the projecting portions of the pistons 56. These chambers, essentially comprising the space between the projecting portions of adjacent pistons, are reduced in volume as the pistons are rotated toward the bottom or short sector of the outer housing. The reduction in volume causes a compression of the gases which are released under pressure through induction ports 80 in the enlarged segment of the core 28 and into the core proper.

The compressed gases in the core have a relatively unobstructed passage to a series of stationary exhaust ports 82 in the core 28. As each cylinder passes the top sector of the housing, a series of cylinder intake ports 84 located in the cylinder and support webbing 40 are instantaneously aligned with core exhaust ports 82. The compressed gas mixture blasts into the combustion chamber 58 scavenging previously combusted gases and charging the cylinder for a compression cycle. A proper scavenging and charging flow into the chamber 58 is developed by deflection vanes 85 on the pistons and the strategic locations of the three intake ports 84. Combusted gases are scavenged out a pair of exhaust ports 86 in the cylinder and support webbing 40 which are similarly aligned with stationary exhaust ports 88 in the cylindrical casing of the outer housing. The exhausted gases are collected in a manifold 90 and either vented or employed to drive auxiliary equipment as described hereafter.

An electrical ignition is necessary to initiate a continuous ignition system during operation of the engine. After the sequential charging of the cylinder chamber 58 at the top or elongated sector of the engine, the gases are compressed by action of the opposed pistons 56 being forced together by the inclined drive plates 24 during the half-revolution compression cycled as the rotor 30 rotates. When two opposed pistons 56 reach the bottom or short sector of the engine, the pistons are at their closest position together, equivalent to a top dead center in a conventional reciprocal piston engine. At this point, in the embodiment shown in FIG. 1, additional fuel is injected through an injection nozzle 92 from a high pressure fuel line 94 into a precombustion chamber 95. On initial firing of the engine, a spark or glow plug 96, generates a spark or hot point at the injection nozzle to ignite the compressed gases in the precombustion chamber 95. The ignited gases enter the combustion chamber 58 through a crossover passsage 98 and force the pistons apart causing a rotation of the rotor during the half-revolution power cycle due to the incline drive plate which by the nature of the incline generates a force vector transverse to the axis of the engine as well as an on-line vector. The transverse force vector is translated to a torsional force by the axial rotor arrangement.

Once firing has commenced, a continuous sequential firing is maintained by a crossover passage 98 which provides a small temporary communication between one chamber and the next adjacent chamber. For example, in FIG. 2, chamber **58*a* overlying piston 56*a* in the sectional view, as just fired and is on its expansion or power stroke driving the rotor in a counter-clockwise direction. The next adjacent chamber 58*b* overlying piston 56*b*, is at top dead center. The crossover passage 98 is on the verge of communicating between chamber 58*a* and 58*b*. When this occurs, a small amount of ignited gas under high pressure in cylinder chamber 58*a* will rush through the crossover passage including the precombustion chamber 95 where additional fuel is injected and enter the adjacent chamber 58*b* carrying and igniting the gas mixture and injected fuel in that chamber 58*b*.** The ignited charge aids in a complete combustion by mixing currents generated during the transfer. This process is continuously repeated as the rotor carried each cylinder chamber into ignition position.

The use of a precombustion chamber 95 and a crossover passage 98 allows a very lean fuel mixture to be utilized with the accompanying savings in fuel costs and reduction of polluting emissions. The precombustion chamber and crossover passage are located in a semicircular block 99 mounted within the central core 28. This block is connected to an end plug 101 by the fuel line 94 and a rigid electrical line 103. The block being stationary, except when rotated with the core as described hereafter, is adapted for mounting a plurality of sparking or glow plugs or other ignition and monitoring means, if desired, to insure complete combustion.

A single precombustion chamber unit including, in addition to the precombustion chamber, ignition means, fuel injection means and crossover passage operates for all pistons. The precombustion unit is mounted within the central core, and, on rotation of the core within defined limits advances or retards ignition, again for all pistons.

Sealing of the engine is primarily a matter of increasing the engine's efficiency rather than reducing pollutant emissions. In this respect, the leakage gases are primarily directed to the induction chambers 66 and are thereby recycled through the engine. Since gases must travel from the exterior into and through the central core and into and through the rotor before final exhaust, a series of port seals are preferred to prevent leakage through the tolerance gaps between the various moving parts. The seals are necessarily heat resistant and suitable for interfacing the moving parts. In FIG. 1, large packing rings 100 circumvent the outer shell 34 of the rotor housing 32. The packing rings 100 are secured to the outer shell and include holes 102 at the exhaust ports 86 to permit the exhaust gases to pass to the exhaust manifold when the exhaust ports 86 are aligned with the stationary exhaust ports 88 in the cylindrical casing 14. The packing rings 100 prevent leakage during the remaining rotation of the rotor 30 when the exhaust ports are not so aligned.

Similarly, smaller packing rings 104 circumvent the central core 28 and include holes 106 at the exhaust ports 82 of the core to permit the supercharged gas mixture from within the core to pass to the cylinder chambers 58 when the exhaust ports 82 of the cores are aligned with the intake ports of the cylinders. The central packing ring 104*a* includes an additional pair of smaller holes to allow proper functioning of the crossover passage 98.

Conventional piston rings 108 on the pistons 56 provide the basic sealing for the pistons 56 in the cylinders.

Specially tailored packing rings 110 preferably comprise the enlarged segment 78 of the central core at each end. Similar, larger, tailored, circumferential packing rings 112 are secured to the inside wall of the end segments 16 of the outer housing 12. These tailored rings increase the efficiency of the supercharging action of the pistons as they are transported around the inside of the end segments of the outer housing. The tailored rings may be fabricated of a softer material than the sealing rings for the various intake and exhaust ports for the cylinders since the thermal and dynamic conditions for the latter rings are more demanding. Alternately, the core and end segments can simply be enlarged preferably during initial casting of the elements.

Since in the preferred embodiment, the outer housing and core are maintained stationary and the elements comprising the rotor rotate within the housing, it is preferred that the piston be balanced to compensate for the inclined end faces. This may be accomplished by a simple weighting by additional metal 114 within the hollow pistons as shown in the broken away section of the exemplar piston in FIG. 1.

If it is desired that the end plates be devised to be adjustable, which is entirely possible utilizing the concepts of this invention, a different arrangement for the end faces of the pistons will be necessary. For example, the piston end faces may be hemispherical in shape without using anchor means and tracks, other than arcuate channels, in the end plates. Initial operation may be commenced by pressurizing the system with compressed air for at least one cycle without fuel before fuel is added and ignition started. In such an arrangement, the integral supercharger formed by the series of induction chambers at the ends of the engine may be eliminated to allow for adjustment in the inclination of the end plates, therefore making such arrangement a collateral rather than preferred embodiment.

When operated in the preferred manner, with the rotor comprising the rotating mass, the engine is best cooled by air which may be admitted through air holes 116 located at various points in the cylindrical casing 14 of the outer housing 12.

If, on the other hand, an alternate arrangement is preferred in which the rotor is maintained stationary and the outer housing and core rotates, it is possible to cool the engine with a water system.

As previously noted, the outer housing and rotor may be so connected that both the outer housing and rotor rotate in opposite directions, such that two complete combustion cycles occur for each cycle of the rotor. This arrangement is schematically shown in FIG. 3.

Referring to FIG. 3, the engine is supported on a mount 120 by pinion gears 122 (four shown in FIG. 3) rotatably mounted in two support rings 124. The pinion gears 122 engage one pair of circumferential ring gears 126 mounted around two rotating end segments 128 of a housing 130 encasing the supercharging chambers (not visible) and another pair of circumferential ring gears 132 mounted around the ends 134 of the exposed rotor 136. The cylindrical outer casing of the outer housing in this embodiment is eliminated to simplify the gearing arrangement. Other modifications will, or course, be necessary. For example, the air or fuel supply is best delivered on axis to the core rather than peripherally.

In such arrangement, power may be extracted from the pinion gears or the engine may be started by rotating one of the pinion gears by suitable attachments.

Since the cylindrical outer casing of the outer housing is not wholly necessary to an operable system, except to aid in directing exhausts in the preferred embodiment, the casing may be utilized for a turbine system. For example, referring to FIG. 4, the engine is constructed with stationary end segments 140 mounted to a support stand 141. A rotatable cylindrical outer casing 142 is constructed to freely rotate around the rotor within. The outer casing 142 includes a turbine fan 144 which is driven by the exhaust gases from the two exhaust ports in the outer shell (not visible) of the rotor. The velocity of the exhausted gases drives the turbine fan 144 and hence the outer casing at an angular velocity substantially greater than the rotating rotor. Exhaust gases are eventually vented around the peripheral edge of the turbine. This added energy can conveniently be utilized to drive two compressor fans 146 at each end of the engine. The compressor fans have a rotating face 148 attached to the rotating casing 142 and a stationary face 150 fixed to the stationary end segments. Compressed air from the compressor fans 146 are transmitted from the fans 146 to the internal supercharger by conduits 152. In this manner, an extremely high pressure and efficiently operating engine is created. Alternately, the conduits can be utilized for delivering cooling air to the engine.

These and other adaptations and modifications may be made to the basic engine described with relation to the preferred embodiment illustrated in FIGS. 1 and 2. The overall axial construction of the engine allows a plurality of engines to be interconnected either on a temporary basis or, by utilizing common end drive plates, on a permanent basis. The availability of various arrangements makes the basic engine adaptable to a variety of uses.

While in the foregoing specification embodiments of the invention have been set forth in considerable detail for purposes of making a complete disclosure thereof, it will be apparent to those skilled in the art that numerous changes may be made in such details without departing from the spirit and principles of the invention.

what is claimed is:

1. A two-cycle reciprocal, rotary, internal combustion engine comprising:

a. a central supply core defining a central engine axis;

b. a plurality of piston cylinders mounted symmetrically around said central engine axis, each cylinder having an axis parallel to said central axis, said piston cylinders being rotatable as a unit around said supply core on said central axis;

c. a plurality of pistons, two pistons being slidably mounted in each of said piston cylinders, each pair of pistons having first ends oppositely facing defining a chamber within each of said cylinders and second ends with a contact face, said contact face being an inclined flat face;

d. two flat drive plates mounted at an inclination with respect to said supply core, said drive plates being tilted toward each other in equilateral trapezoidal fashion, said contact end faces of said pistons interfacing said inclined drive plates, and being coplanar and slidably engageable therewith;

e. two cycle intake and exhaust means cooperatively arranged with said cylinders for admitting and exhausting gases; and, f. ignition means cooperatively arranged with said cylinders for igniting gases in said cylinders.

2. The engine of claim 1 wherein said intake and exhaust means comprise a pair of intake ports and a pair of exhaust ports substantially opposite said intake ports in said cylinders, said ports in each pair being spaced apart for exposure adjacent said first ends of said pistons when said pistons are at a substantially maximum displacement.

3. The engine of claim 2 wherein said pistons include at their first ends, deflection vanes.

4. The engine of claim 1 wherein said piston cylinders are symmetrically arranged in a rigid unit comprising a rotor, said rotor having bearing means for rotatably cooperating with said central supply core.

5. The engine of claim 4 in combination with a supercharger.

6. The engine of claim 1 wherein said inclined face of said second ends of said pistons includes anchor means cooperating with said drive plates to maintain said inclined end faces of said pistons substantially against said drive plates.

7. The engine of claim 6 wherein said pistons include balancing means for compensating for the incline of the end face.

8. The engine of claim 1 wherein said supply core and drive plates are stationary and said piston cylinders and pistons rotate about said central engine axis.

9. The engine of claim 1 wherein said piston cylinders and pistons comprise a rotationally stationary unit and said supply core and drive plate rotate about said central engine axis.

10. The engine of claim 1 having engine mounting means for rotating said supply core and drive plates in a first angular direction and concurrently rotating said cylinders and pistons as a unit in an opposite direction.

11. The engine of claim 1 having further an integral turbine cooperating with said two cycle exhaust means.

12. The engine of claim 1 having further an integral compressor fan.

13. The engine of claim 1 having further a carbureted fuel and air system cooperating with said two cycle intake means.

14. The engine of claim 1 having further a cooperating carbureted fuel and air system, cooperating with said two cycle intake means.

15. The engine of claim 1 in combination with additional like engines mounted in multiples on a single drive shaft.

16. A two-cycle reciprocal, rotary, internal combustion engine comprising:

a. central supply core defining a central engine axis;

b. a plurality of piston cylinders mounted symmetrically spaced around said central engine axis, each cylinder having an axis parallel to said central axis, said piston cylinders forming a unit rotatable around said supply core on said central axis;

c. a plurality of pistons, two pistons being slidably mounted in each of said piston cylinders, each pair of pistons having first ends oppositely facing defining a compression chamber within each of said cylinders and second ends with a flat incline contact face;

d. two drive plates mounted at an inclination with respect to said supply core, said drive plates being tilted toward each other in equilateral trapezoidal fashion wherein said combustion engine is generally cylindrical in configuration with an elongated side and a short side, said flat contact end faces of said pistons interfacing said inclined drive plates, and being slidably engageable therewith wherein said drive plates are spaced from said piston cylinders and said pistons have a portion thereof at said second ends projecting from said cylinders to said drive plates;

e. sealing means between said drive plates and said piston cylinders forming a substantially sealed annular passage around which said projecting portions of said pistons traverse during rotation of said piston cylinders, said sealing means and said projecting portions of said pistons defining a plurality of variable volume induction chambers between said projecting portions of adjacent pistons for compressing and transporting gases' said sealing means including gas intake means to said induction chambers on said elongated side of said engine and gas exhaust means from said induction chambers at said short side of said engine;

f. two cycle intake and exhaust means cooperatively arranged with said cylinders for admitting and exhausting gases of said compression chambers; and g. ignition means cooperatively arranged with said cylinders for igniting gases in said cylinders.

17. The engine of claim 16 comprising further:

a. two spaced end plates mounted to and orthoganal with said piston cylinders said pistons having the projecting portions of said pistons projecting through said end plates;

b. a cylindrical shell housing having two end segments encompassing the projecting portions of said pistons, said housing end segments extending between and cooperating with said end plates and said drive plates to define an enclosure at each end of the engine around the projecting portions of the pistons, said enclosures having gas induction ports at said elongated side of said engine;

c. two hollow cylindrical extension segments on said supply core extending between said drive plates, said extension segments having gas intake ports on said bottom side of said engine, wherein said end segments of said housing include an inner wall and said supply core has an outer wall, said walls being proximately arranged with said projecting portions of said pistons to define the annular passage of said sealing means;

18. A two-cycle reciprocal, rotary, internal combustion engine comprising;

a. a central supply core defining a central engine axis;

b. a plurality of piston cylinders mounted symmetrically around said central engine axis, each cylinder having an axis parallel to said central axis, said piston cylinders being rotatable as a unit around said supply core on said central axis;

c. a plurality of pistons, two pistons being slidably mounted in each of said piston cylinders, each pair of pistons having first ends oppositely facing defining a chamber within each of said cylinders and second ends with a contact face;

d. two drive plates mounted at an inclination with respect to said supply core, said drive plates being tilted toward each other in equilateral trapezoidal fashion, said contact end faces of said pistons interfacing said inclined drive plates, and being slidably engageable therewith;

e. two cycle intake and exhaust means cooperatively arranged with said cylinders for admitting and exhausting gases; and, f. ignition means cooperatively arranged with said cylinders for igniting gases in said cylinders; said ignition means including a pre-combustion crossover passage said combustion crossover passage being in sequential temporary communication between one chamber in one first cylinder in which gases have been ignited and a second chamber in a next adjacent second cylinder to said first cylinder, said combustion crossover passage being oriented to communicate between said adjacent cylinders when said first cylinder has pistons being displaced in a power stroke and said second cylinder has pistons at substantially maximum proximity in a compression stroke, wherein a continuous sequential ignition by ignited gases through said crossover passage is maintained.

19. The engine of claim 18, said central supply core having a single precombustion chamber unit housing a precombustion chamber, ignition means, fuel injection means and crossover passage, said central supply core being rotatable for advancing or retarding ignition, wherein initial ignition takes place in the precombustion chamber allowing precise fuel control burning any fuel that will ignite.

20. The engine of claim 19 wherein said precombustion chamber unit is located within a block adapted for mounting a plurality of ignition and monitoring means in said core.

* * * * *